US006559804B2

(12) United States Patent
Nakano et al.

(10) Patent No.: US 6,559,804 B2
(45) Date of Patent: May 6, 2003

(54) ELECTROMAGNETIC COUPLING TYPE FOUR-POINT LOOP ANTENNA

(75) Inventors: Hisamatsu Nakano, Kodaira (JP); Akira Miyoshi, Chofu (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/032,937

(22) Filed: Dec. 27, 2001

(65) Prior Publication Data

US 2003/0063038 A1 Apr. 3, 2003

(30) Foreign Application Priority Data

Sep. 28, 2001 (JP) ..... 2001-300022

(51) Int. Cl.[7] ..... H01Q 11/12; H01Q 1/50

(52) U.S. Cl. ..... 343/743; 343/700 MS; 343/857

(58) Field of Search ..... 343/741, 742, 343/743, 744, 866, 867, 700 MS, 895, 853

(56) References Cited

U.S. PATENT DOCUMENTS 5,134,422 A * 7/1992 Auriol ..... 343/895
5,986,616 A * 11/1999 Edvardsson ..... 343/853

* cited by examiner

*Primary Examiner*—Hoang Nguyen
(74) *Attorney, Agent, or Firm*—Frishauf, Holtz, Goodman & Chick, P.C.

(57) ABSTRACT

An electromagnetic coupling type four-point feeding loop antenna (10) comprises a cylindrical body (11) formed by rounding a flexible insulator film member (20) around a central axis (O) in a cylindrical fashion and a loop portion (12) made of conductor that is formed on the cylindrical body along a peripheral surface thereof around the central axis in a loop fashion. In order to feed to the loop portion at four points, four feeders (13) are formed on the peripheral surface of the cylindrical body. Between the loop portion and each of the four feeders, a gap ($\delta_1$) is provided, whereby carrying out feed to the loop portion by electromagnetic coupling.

4 Claims, 5 Drawing Sheets

ELECTROMAGNETIC COUPLING TYPE FOUR-POINT LOOP ANTENNA

BACKGROUND OF THE INVENTION

This invention relates to a digital radio receiver for receiving an electric wave from an artificial satellite (that may be called a "satellite wave") or an electric wave on the ground (that may be called a "ground wave") to listen in a digital radio broadcasting and, in particular, to a loop antenna for use in the digital radio receiver.

In recent years, a digital radio receiver, which receives the satellite wave or the ground wave to listen in the digital radio broadcasting, has been developed and is put to practical use in the United States of America. The digital radio receiver is mounted on a mobile station such as an automobile and can receive an electric wave having a frequency of about 2.338 gigahelts (GHz) to listen in a radio broadcasting. That is, the digital radio receiver is a radio receiver which can listen in a mobile broadcasting. In addition, the ground wave is an electric wave in which a signal where the satellite wave is received in an earth station is frequently shifted a little.

In order to receive such an electric wave having the frequency of about 2.338 GHz, it is necessary to set up an antenna outside the automobile. Although a variety of antennas having various structures have been proposed, the antennas of cylindrical-type are generally used rather than those of planer-type (plane-type). This is because a wider directivity is achieved by forming the antenna into a cylindrical shape.

A loop antenna is known in the art as one of the antennas of the cylindrical-type. The loop antenna has structure where one antenna lead member is wound around a peripheral surface of a hollow or solid cylindrical (which is collectively called "cylindrical") member in a loop fashion, namely, is an antenna having the form of a loop. The cylindrical member may be merely called a "bobbin" or a "dielectric core" in the art. In addition, the antenna lead member may be merely called a "lead." It is known in the art that the loop antenna acts as an antenna having a directivity in a longitudinal direction thereof if the antenna lead member has an all around length which is selected to about one wavelength. This is because the antenna lead member has a sinusoidal distribution of a current.

Although it is necessary for the loop antenna to feed to it, a four-point feeding is generally adopted to the loop antenna. In order to receive circular polarization, feeding is carried out at four points having a phase difference of 90 degrees from one another. The loop antenna with the four-point feeding is called in the art a four-point feeding loop antenna. In a conventional four-point feeding loop antenna, a feeding is directly carried out to a loop portion.

More specifically, the conventional four-point loop antenna comprises a cylindrical body formed by rounding a flexible insulation film around a central axis in a cylindrical fashion, a loop portion made of conductor that is formed on the cylindrical body along a peripheral surface thereof around the central axis in a loop fashion, and four feeders formed on the peripheral surface of the cylindrical body to feed the loop portion at four points. The loop portion is directly connected with each of the four feeders.

After the electric wave is received by the loop portion as a received wave, the received wave is divided through the four feeders into four partial received waves which are phase shifted and combined by a phase shifter so as to match phases of the four partial received waves to obtain a combined wave, and then the combined wave is amplified by a low-noise amplifier (LNA) to obtain an amplified wave which is delivered to a receiver body. A combination of the four-point feeding loop antenna, the phase shifter, and the low-noise amplifier is called an antenna unit.

In the manner which is described above, inasmuch as the conventional four-point feeding loop antenna directly feeds the loop portion from the four feeders, the conventional four-point feeding loop antenna is disadvantageous in that it has a too high feeding impedance. Thus, the conventional four-point feeding loop antenna is disadvantageous in that it is difficult to obtain an impedance match.

SUMMARY OF THE INVENTION

It is therefore an object of the present invention to provide a four-point feeding loop antenna which is capable of easily obtain an impedance match.

Other objects of this invention will become clear as the description proceeds.

According to an aspect of this invention, an electromagnetic coupling type four-point feeding loop antenna comprises a cylindrical body formed by rounding a flexible insulator film member around a central axis in a cylindrical fashion. The cylindrical body has a peripheral surface. Made of conductor, a loop portion is formed on the cylindrical body along the peripheral surface around the central axis in a loop fashion. Four feeders are formed on the peripheral surface of the cylindrical body to feed to the loop portion at four points. The electromagnetic coupling type four-point feeding loop antenna has gaps between the loop portion and the four feeders, thereby feeding to the loop portion by electromagnetic coupling.

In the above-mentioned electromagnetic coupling type four-point feeding loop antenna, the flexible insulator film member may substantially have a rectangular shape having an upper side, a lower side, a first lateral side, and a second lateral side. In this event, the cylindrical body is formed by connecting the first lateral side with the second lateral side. The loop portion may be formed on one surface of the flexible insulator film member in the vicinity of the upper side.

Each of the four feeders may extend on the flexible insulator film member from the lower side to the vicinity of said loop portion. In this event, the loop portion is connected with four electromagnetic coupling wires extending on the flexible insulator film member from the loop portion along the four feeders toward the lower side with the gaps left between the four feeders and the four electromagnetic coupling wires, respectively.

Alternatively, each of the four feeders may comprise a main feeding wire portion extending on the flexible insulator film member from the lower side to the vicinity of the loop portion and a sub-feeding wire portion extending on the flexible insulator film member in parallel with the loop portion from a tip of the main feeding wire portion with the gap left between the loop potion and the sub-feeding wire portion.

DESCRIPTION OF THE PREFERRED EMBODIMENT

Referring to FIGS. 1A, 1B, 2, and 3, the description will proceed to an electromagnetic coupling type four-point feeding loop antenna 10 according to a first embodiment of this invention. The illustrated electromagnetic coupling type four-point feeding loop antenna 10 has a central axis O and comprises a cylindrical body 11, a loop portion 12, four feeders 13.

The cylindrical body 11 is formed by rounding a flexible insulator film member (which will later be described) around the central axis O in a cylindrical fashion in the manner which will later be described. The loop portion 12 is made of conductor and is formed on the cylindrical body 11 along a peripheral surface thereof around the central axis O in a loop fashion. The four feeders 13 are formed on the peripheral surface of the cylindrical body 11 to feed to the loop portion 12 at four points. As the conductor of the loop portion 12, for example, copper foil is used. In addition, the flexible insulator film member for use in the cylindrical body 11, for example, plastic such as polyimide resin is used. In the example being illustrated, the cylindrical body 11 has a diameter of 20 mm.

According to this invention, the electromagnetic coupling type four-point feeding loop antenna 10 has gaps $\delta_1$ between the loop portion 12 and the four feeders 13 to feed to the loop portion 12 by electromagnetic coupling. In the example being illustrated, each gap $\delta_1$ is equal to, for example, 0.4 mm and preferably may lie in a range of 0.2–0.8 mm.

Figure 1A:
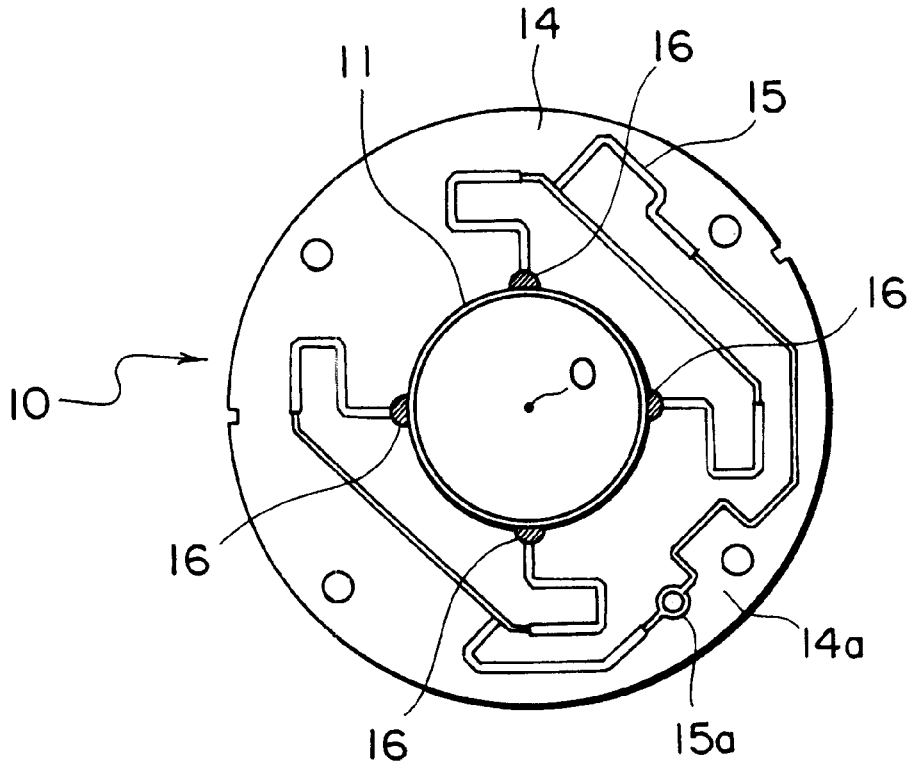
FIG. 1A is a plan view showing an electromagnetic coupling type four-point feeding loop antenna according to a first embodiment of this invention.
Figure 1B:
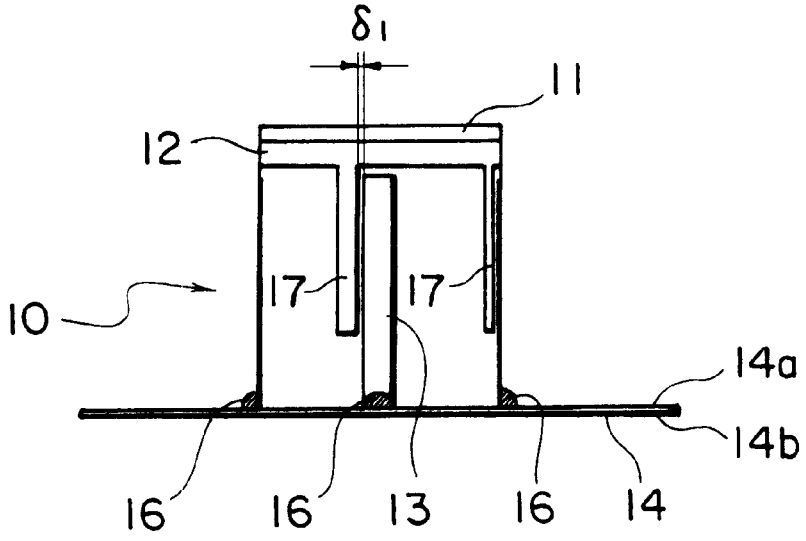
FIG. 1B is a front view of the electromagnetic coupling type four-point feeding loop antenna illustrated in FIG. 1A.
Figure 2:
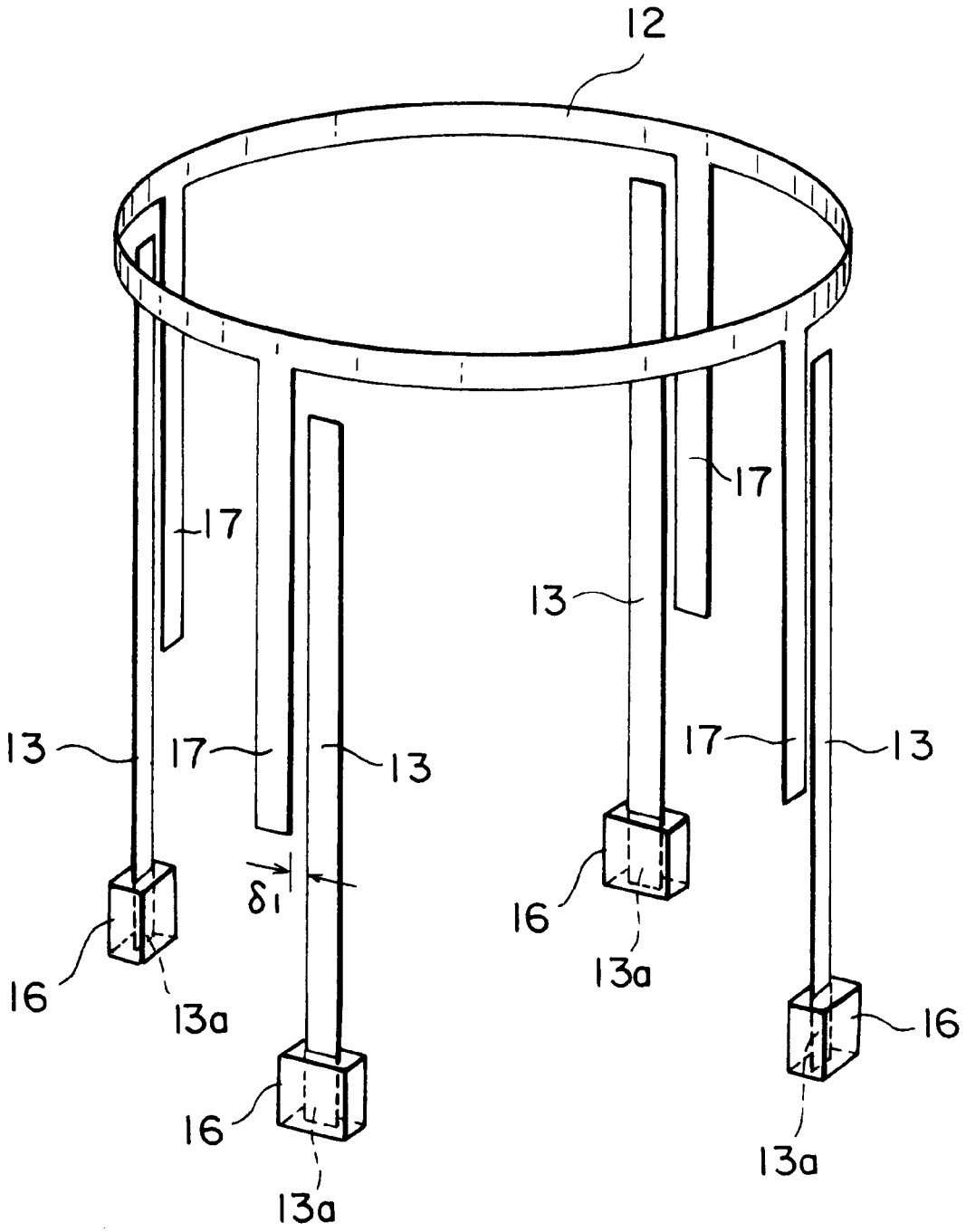
FIG. 2 is a perspective view showing an arrangement relationship between a loop portion and four feeders which constitute the electromagnetic coupling type four-point feeding loop antenna illustrated in FIGS. 1A and 1B.

As shown in FIGS. 1A and 1B, the cylindrical body 11 has a longitudinal lower end which is fixed on a circuit board 14. The circuit board 14 has a main surface 14*a* on which a phase shifter 15 is formed. The circuit board 14 has a back surface 14*b* on which a ground conductive pattern (not shown) is formed.

In addition, the four feeders 13 have four feeding terminals 13*a* (FIG. 2) which are electrically and mechanically connected to input terminals of the phase shifter 15 using solder 16.

Figure 3:
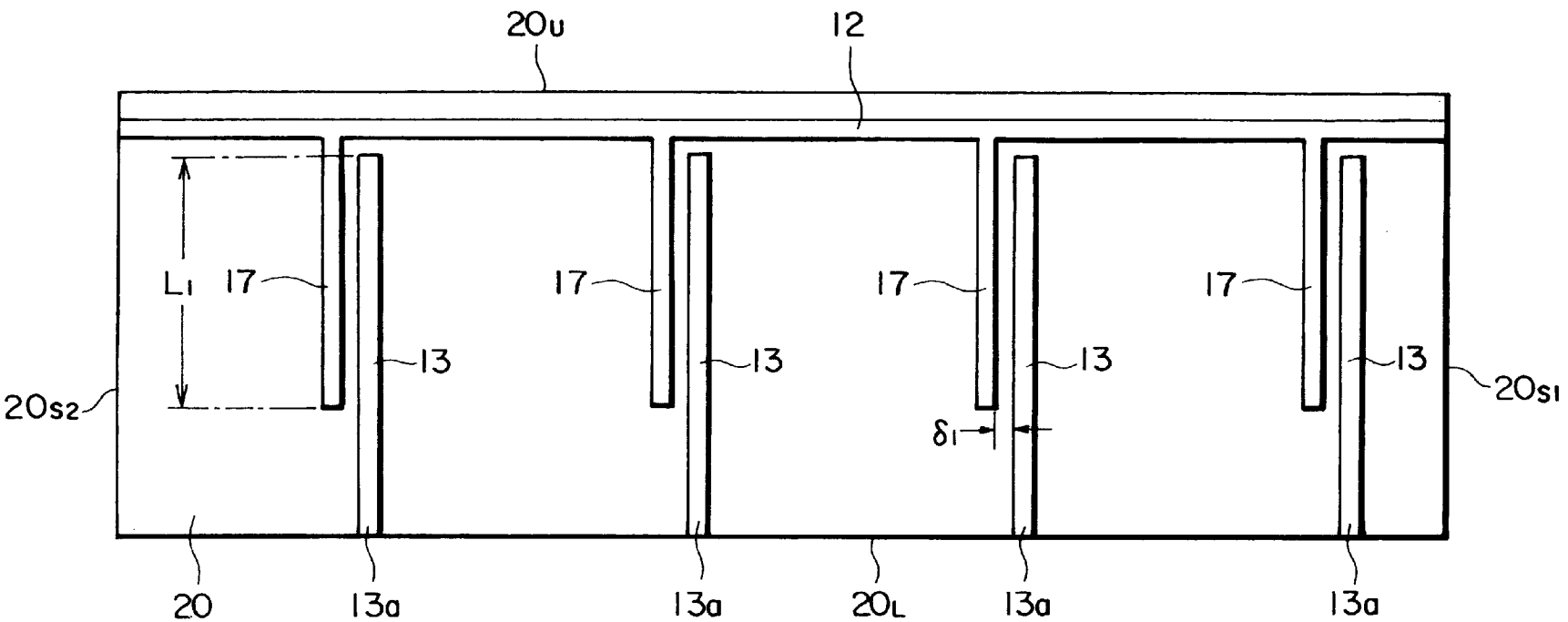
FIG. 3 is development of the electromagnetic coupling type four-point feeding loop antenna illustrated in FIGS. 1A and 1B.

Referring to FIG. 3, the flexible insulator film member 20 for use in forming the cylindrical body 11 substantially has a rectangular shape which has an upper side $\mathbf{20}^U$, a lower side $\mathbf{20}^L$, a first lateral side $\mathbf{20}^{S1}$, and a second lateral side $\mathbf{20}^{S2}$. By connecting the first lateral side $\mathbf{20}^{S1}$ with the second lateral side $\mathbf{20}^{S2}$, the cylindrical body 11 is formed as shown in FIGS. 1A and 1B. This connection between the first lateral side $\mathbf{20}^{S1}$ and the second lateral side $\mathbf{20}^{S2}$ is carried out, for example, by using double-sided adhesive tape or an adhesive agent.

In addition, the loop portion 12 is formed on one surface of the flexible insulator film member 20 in the vicinity of the upper side $\mathbf{20}^U$. While the cylindrical body 11 is formed by rounding the flexible insulator film member 20, both ends of the loop portion 12 are electrically connected to each other.

In the electromagnetic coupling type four-point feeding loop antenna 10, each of the four feeders 13 extends in parallel with the central axis O from the lower side $\mathbf{20}^L$ and the vicinity of the loop portion 12. In addition, the loop portion 12 is connected with four electromagnetic coupling wires 17 which extend from the loop portion 12 toward the lower side $\mathbf{20}^L$ along the four feeders 13 with the gaps $\delta_1$ left between the four feeders 13 and the four electromagnetic coupling wires 17, respectively. By changing a coupling length $L_1$ between the feeder 13 and the electromagnetic coupling wire 17 which are adjacent to each other, it is possible to change a frequency characteristic of the electromagnetic coupling type four-point feeding loop antenna 10.

Formed on the one surface of the flexible insulator film member 20, the loop portion 12, the four feeders 13, and the four electromagnetic coupling wires 17 may be made of the conductive material (e.g. copper file).

In general, it is necessary in a four-point feeding loop antenna to make a feeding impedance thereof 50 Ω. In the electromagnetic coupling type four-point feeding loop antenna 10 according to the first embodiment of this invention, it is possible to lower an impedance at each feeding terminal 13*a* up to 25 Ω. Accordingly, it is possible to make an impedance at an output terminal 15*a* of the phase shifter 15 50 Ω. That is, by feeding to the loop portion 12 by electromagnetic coupling, it is possible to easily obtain the impedance match.

In addition, it is possible to change the impedance at each feeding terminal 13*a* by changing a size of each gap $\delta_1$.

On the contrary, in a conventional four-point feeding loop antenna having structure where each feeder 13 is directly connected to the loop portion 12, each feeding terminal 13*a* has a too high impedance of 250–300 Ω. As a result, it is difficult to obtain impedance match at the output terminal 15*a* of the phase shifter 15.

Figure 4A:
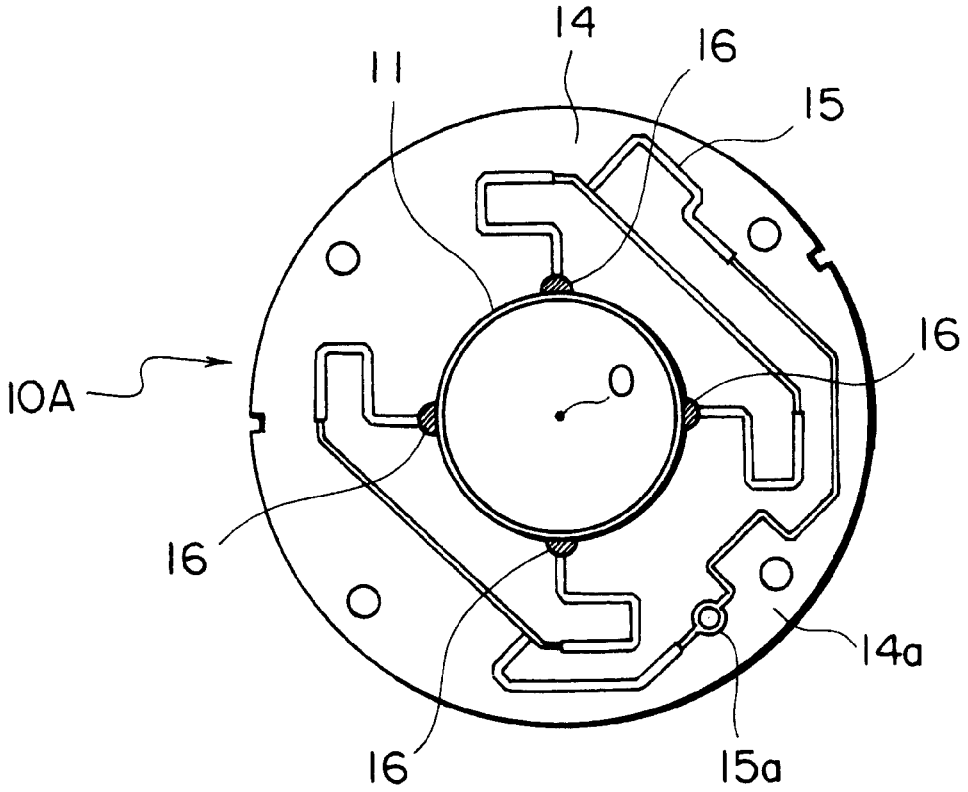
FIG. 4A is a plan view showing an electromagnetic coupling type four-point feeding loop antenna according to a second embodiment of this invention.
Figure 4B:
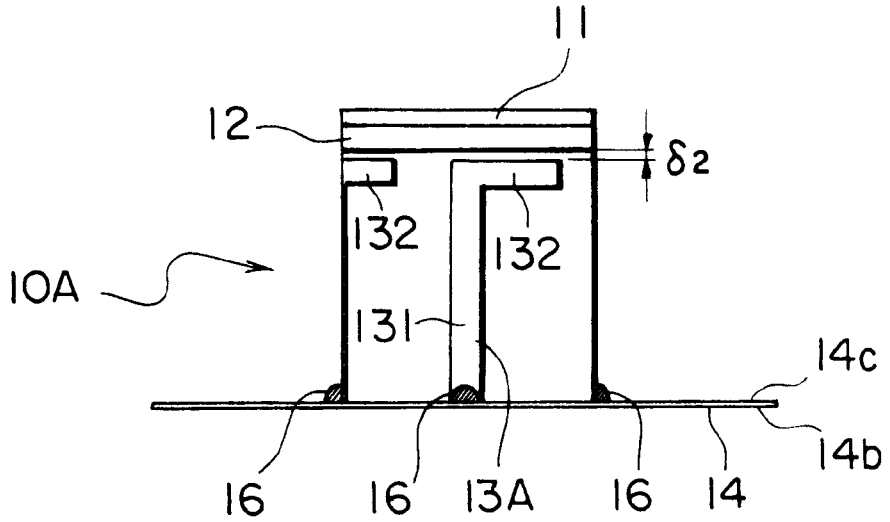
FIG. 4B is a front view of the electromagnetic coupling type four-point feeding loop antenna illustrated in FIG. 4A.
Figure 5:
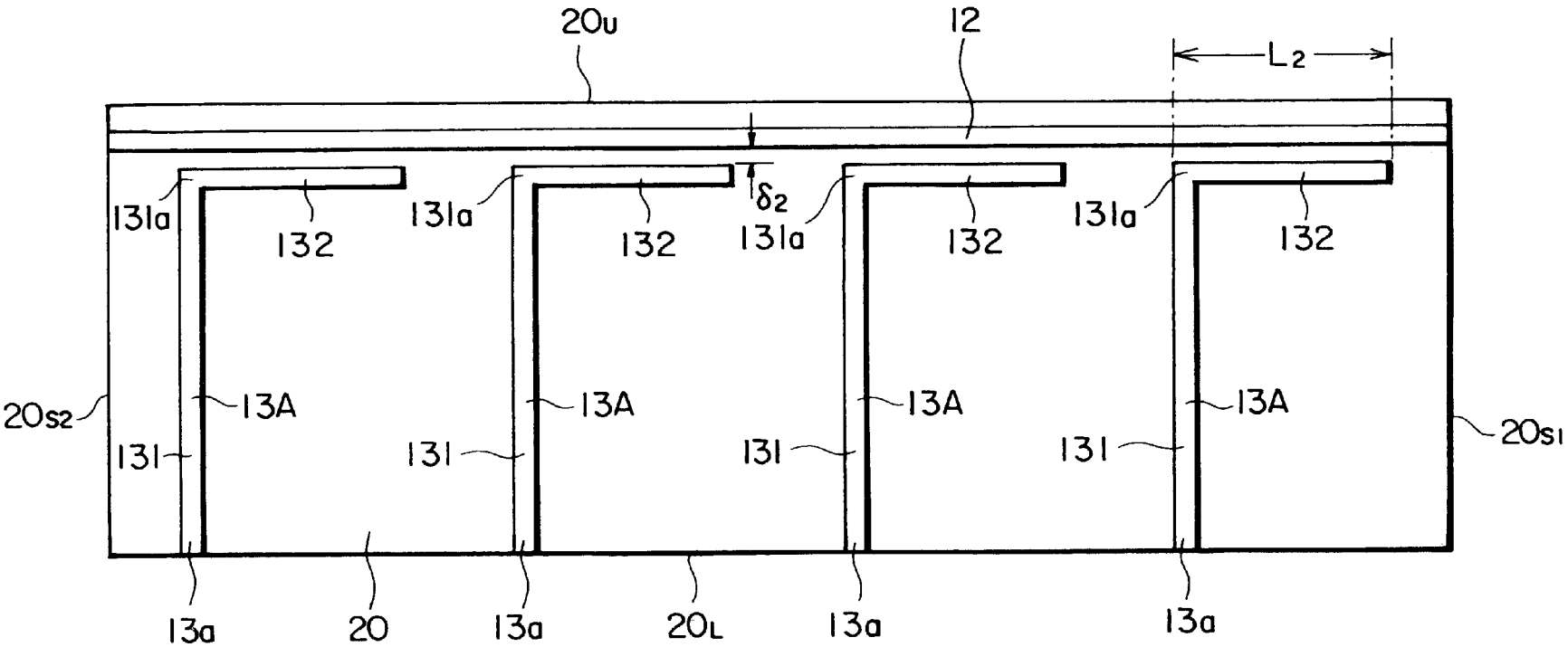
FIG. 5 is development of the electromagnetic coupling type four-point feeding loop antenna illustrated in FIGS. 4A and 4B.

Referring to FIGS. 4A, 4B, and 5, the description will proceed to an electromagnetic coupling type four-point feeding loop antenna 10A according to a second embodiment of this invention. The illustrated electromagnetic coupling type four-point feeding loop antenna 10A is similar in structure to that illustrated in FIG. 1A, 1A, 2, and 3 except that structure of the feeders are modified or different from those illustrated in FIGS. 1A, 1B, 2, and 3 in the manner which will later become clear. The feeders are therefore depicted at 13A. Similar reference symbols are attached to those similar to the electromagnetic coupling type four-point feeding loop antenna 10 in illustrated in FIGS. 1A, 1B, 2, and 3 and description thereof is omitted to simplifying description.

Each of the four feeders 13A comprises a main feeding wire portion 131 and a sub-feeding wire portion 132. The main feeding wire portion 131 extends in parallel with the central axis O from the lower side $\mathbf{20}^L$ of the flexible insulator film member 20 to the vicinity of the loop portion 12. The sub-feeding wire portion 132 extends from a tip 131*a* of the main feeding wire portion 131 in parallel with the loop portion 12 with a gap $\delta_2$ left between the loop portion 12 and the sub-feeding wire portion 132 in question.

By changing a coupling length $L_2$ between each sub-feeding wire portion 132 and the loop portion 12, it is possible to change a frequency characteristic of the electromagnetic coupling type four-point feeding loop antenna 10A. In addition, it is possible to change an impedance at each feeding terminal 13*a* by changing a size of the gap $\delta_2$.

In the electromagnetic coupling type four-point feeding loop antenna 10A according to the second embodiment of this invention also, in similar manner as the electromagnetic coupling type four-point feeding loop antenna 10 according to the first embodiment of this invention, it is possible to lower an impedance at each feeding terminal 13*a* because a feeding for the loop portion 12 is carried out by electromagnetic coupling. It is therefore possible to make an impedance at the output terminal 15*a* of the phase shifter 15 50 Ω.

While this invention has thus far been described in conjunction with a few preferred embodiment thereof, it will now be readily possible for those skilled in the art to put this invention into various other manners. For example, although the feeders 13 (the main feeding wire portions 131) and the electromagnetic coupling wires 17 substantially extend a normal direction to the lower side $\mathbf{20}^L$ of the flexible insulator film member 20 in the above-mentioned embodiments, they may substantially extend in an oblique direction to the lower side $\mathbf{20}^L$ of the flexible insulator film member 20.

What is claimed is:

1. An electromagnetic coupling type four-point feeding loop antenna comprising:

a cylindrical body formed by rounding a flexible insulator film member around a central axis in a cylindrical fashion, said cylindrical body having a peripheral surface;

a loop portion made of conductor, said loop portion being formed on said cylindrical body along said peripheral surface around said central axis in a loop fashion; and four feeders formed on the peripheral surface of said cylindrical body to feed to said loop portion to four points, said electromagnetic coupling type four-point feeding loop antenna having gaps between said loop portion and said four feeders, thereby feeding to said loop portion by electromagnetic coupling.

2. An electromagnetic coupling type four-point feeding loop antenna as claimed in claim 1, wherein said flexible insulator film member substantially has a rectangular shape having an upper side, a lower side, a first lateral side, and a second lateral side, said cylindrical body being formed by connecting said first lateral side with said second lateral side, said loop portion being formed on one surface of said flexible insulator film member in the vicinity of the upper side.

3. An electromagnetic coupling type four-point feeding loop antenna as claimed in claim 2, wherein each of said four feeders extends on said flexible insulator film member from said lower side to the vicinity of said loop portion, said loop portion being connected with four electromagnetic coupling wires extending on said flexible insulator film member from said loop portion along said four feeders toward said lower side with said gaps left between said four feeders and said four electromagnetic coupling wires, respectively.

4. An electromagnetic coupling type four-point feeding loop antenna as claimed in claim 2, wherein each of said four feeders comprising:

a main feeding wire portion extending on said flexible insulator film member from said lower side to the vicinity of said loop portion; and a sub-feeding wire portion extending on said flexible insulator film member in parallel with said loop portion from a tip of said main feeding wire portion with said gap left between said loop potion and said sub-feeding wire portion.

* * * * *